US008937586B2

(12) United States Patent
Wang et al.

(10) Patent No.: US 8,937,586 B2
(45) Date of Patent: Jan. 20, 2015

(54) DEVICE FOR REDUCING FLICKERS OF A LIQUID CRYSTAL DISPLAY PANEL AND METHOD FOR REDUCING FLICKERS OF A LIQUID CRYSTAL DISPLAY PANEL

(71) Applicant: Chunghwa Picture Tubes, Ltd., Taoyuan County (TW)

(72) Inventors: Shih-Yu Wang, Tainan (TW); Chia-Yi Lu, Taoyuan County (TW)

(73) Assignee: Chunghwa Picture Tubes, Ltd., Longtan Township, Taoyuan County (TW)

( * ) Notice: Subject to any disclaimer, the term of this patent is extended or adjusted under 35 U.S.C. 154(b) by 235 days.

(21) Appl. No.: 13/650,140

(22) Filed: Oct. 12, 2012

(65) Prior Publication Data

US 2014/0071034 A1 Mar. 13, 2014

(30) Foreign Application Priority Data

Sep. 7, 2012 (TW) ..... 101132780 A

(51) Int. Cl.
*G09G 3/36* (2006.01)

(52) U.S. Cl.
USPC ..... 345/98; 345/94; 345/103

(58) Field of Classification Search
CPC ..... G09G 3/36
USPC ..... 345/52, 94, 98–100, 571, 565, 560, 345/556, 534, 103
See application file for complete search history.

(56) References Cited

U.S. PATENT DOCUMENTS

| | | | | |
|---|---|---|---|---|
| 7,239,742 | B2 * | 7/2007 | Ohtani et al. | 382/162 |
| 8,537,083 | B2 * | 9/2013 | Nakatsuka | 345/87 |
| 2003/0227431 | A1 | 12/2003 | Chung et al. | |
| 2005/0200631 | A1 * | 9/2005 | Pan et al. | 345/600 |
| 2006/0221029 | A1 * | 10/2006 | Hsu et al. | 345/88 |
| 2007/0002005 | A1 * | 1/2007 | Kim et al. | 345/103 |
| 2008/0111767 | A1 * | 5/2008 | Liu et al. | 345/58 |
| 2008/0180589 | A1 * | 7/2008 | Woo et al. | 349/38 |
| 2008/0204444 | A1 * | 8/2008 | Ryu et al. | 345/214 |
| 2008/0259019 | A1 * | 10/2008 | Ng | 345/98 |
| 2008/0278426 | A1 * | 11/2008 | Chen et al. | 345/96 |
| 2009/0135124 | A1 * | 5/2009 | Nakatsuka | 345/94 |
| 2009/0315920 | A1 * | 12/2009 | Sakurai et al. | 345/690 |
| 2011/0032231 | A1 * | 2/2011 | Maruyama et al. | 345/208 |
| 2011/0193848 | A1 * | 8/2011 | Kojima | 345/211 |

(Continued)

FOREIGN PATENT DOCUMENTS

| | | | |
|---|---|---|---|
| CN | 101082710 | A | 12/2007 |
| CN | 101211033 | A | 7/2008 |

(Continued)

*Primary Examiner* — Allison Johnson
*Assistant Examiner* — Vinh Lam
(74) *Attorney, Agent, or Firm* — Winston Hsu; Scott Margo

(57) ABSTRACT

A device for reducing flickers of a liquid crystal display panel is disclosed. The liquid crystal display panel is divided into a plurality of blocks. The device includes a memory, a common voltage generation unit, and a controller. The memory is used for storing a plurality of initial codes. Each initial code corresponds to a block of the plurality of blocks and a common voltage. The controller is used for generating a control signal to the common voltage generation unit when the controller starts to count scan start signals corresponding to the block. The common voltage generation unit is used for reading the initial code from the memory according to the control signal, and generating the common voltage to the block according to the initial code.

10 Claims, 8 Drawing Sheets

(56) References Cited

U.S. PATENT DOCUMENTS

| | | | | |
|---|---|---|---|---|
| 2011/0221983 | A1 | 9/2011 | Lee | |
| 2011/0227891 | A1* | 9/2011 | Lee | 345/211 |
| 2011/0227955 | A1* | 9/2011 | Lee et al. | 345/690 |
| 2011/0273480 | A1* | 11/2011 | Park et al. | 345/690 |
| 2012/0218322 | A1* | 8/2012 | Shiomi | 345/690 |
| 2012/0320018 | A1* | 12/2012 | Saitoh et al. | 345/209 |
| 2014/0071034 | A1* | 3/2014 | Wang et al. | 345/99 |

FOREIGN PATENT DOCUMENTS

| | | |
|---|---|---|
| TW | I263082 | 10/2006 |
| TW | 200822030 | 5/2008 |
| TW | 201131548 | 9/2011 |
| TW | 201232506 | 8/2012 |

* cited by examiner

DEVICE FOR REDUCING FLICKERS OF A LIQUID CRYSTAL DISPLAY PANEL AND METHOD FOR REDUCING FLICKERS OF A LIQUID CRYSTAL DISPLAY PANEL

BACKGROUND OF THE INVENTION

1. Field of the Invention

The present invention relates to a device for reducing flickers of a liquid crystal display panel and a method for reducing flickers of a liquid crystal display panel, and particularly to a device and a method that can utilize each of a plurality of blocks of the liquid crystal display panel to correspond to a respective common voltage to reduce flickers of the liquid crystal display panel.

2. Description of the Prior Art

Please refer to FIG. 1. FIG. 1 is a diagram illustrating a plurality of pixels included by a liquid crystal display panel. As shown in FIG. 1, each pixel includes a thin film transistor 102, a liquid crystal capacitor CLC, and a storage capacitor CS, where a gate G of the thin film transistor 102 is coupled to a gate line G1, a source S of the thin film transistor 102 is coupled to a data line D1, and a drain D of the thin film transistor 102 is coupled to a liquid crystal capacitor CLC and a storage capacitor CS. In addition, another terminal of the liquid crystal capacitor CLC and another terminal of the storage capacitor CS are coupled to a common electrode COM.

Please refer to FIG. 2. FIG. 2 is a diagram illustrating a pixel 200 of a liquid crystal display panel. As shown in FIG. 2, the pixel 200 includes a thin film transistor 202, a liquid crystal capacitor CLC, and a storage capacitor CS, where a gate G of the thin film transistor 202 is coupled to a gate line G1, a source S of the thin film transistor 202 is coupled to a data line D1, and a drain D of the thin film transistor 202 is coupled to a liquid crystal capacitor CLC and a storage capacitor CS, where a parasitic capacitor Cgd exists between the gate G and the drain D of the thin film transistor 202. In addition, another terminal of the liquid crystal capacitor CLC and another terminal of the storage capacitor CS are coupled to a common electrode COM.

FIG. 3 is a diagram illustrating relationships of a voltage stored in the storage capacitor CS and the liquid crystal capacitor CLC, a data voltage VDATA of the data line D1, a common voltage VCOM, a high gate voltage VGH and a low gate voltage VGL of the gate line G1 in FIG. 2. As shown in FIG. 3, when the liquid crystal display panel displays an $N^{th}$ frame, the thin film transistor 202 is turned on according to the high gate voltage VGH of the gate line G1, so the data voltage VDATA of the data line D1 charges the liquid crystal capacitor CLC and the storage capacitor CS. Meanwhile, a voltage of the drain D of the thin film transistor 202 is gradually increased to a voltage VP1. When the thin film transistor 202 is turned off according to the low gate voltage VGL of the gate line G1, the voltage of the drain D of the thin film transistor 202 instantly reduces a feed through voltage ΔVP due to a capacitive effect of the parasitic capacitor Cgd. That is to say, the voltage the drain D of the thin film transistor 202 is decreased to a voltage VP2. Similarly, when the liquid crystal display panel displays an $(N+1)^{th}$ frame, the voltage of the drain D of the thin film transistor 202 also exhibits the feed through voltage ΔVP. Thus, the liquid crystal display panel has flickers because a positive feed through voltage ΔVPP is unequal to a negative feed through voltage ΔVPN. In addition, the feed through voltage ΔVP is determined by conservation of charge and equation (1):

$$\Delta VP = \frac{Cgd}{Cgd + CLC + CS}\Delta VG \tag{1}$$

As shown in equation (1), ΔVP=VP1−VP2, and ΔVG=VGH−VGL.

As shown in FIG. 3 and equation (1), when the common voltage VCOM provided by the common electrode COM is a direct current voltage, a liquid crystal display panel designer can compensate flickers of the liquid crystal display panel caused by the feed through Voltage ΔVP by adjusting a direct current level of the common voltage VCOM to let the positive feed through voltage ΔVPP be equal to the negative feed through voltage ΔVPN. Meanwhile, the common voltage VCOM is determined by equation (2):

$$\Delta VCOM = \frac{\Delta VDATA}{2} - \Delta VP \tag{2}$$

As shown in FIG. 3, ΔVDATA is a difference between a high voltage and a low voltage of the data line D1.

Please refer to FIG. 4. FIG. 4 is a diagram illustrating a liquid crystal display panel 400 having different feed through voltages. A plurality of blocks B1-B5 of the liquid crystal display panel 400 have different parasitic capacitors due to a liquid crystal display panel process. For example, capacitances of parasitic capacitors of the block B1 and the block B5 are smaller, and a capacitance of a parasitic capacitor of the block B3 is greater. Therefore, as shown in FIG. 4, because the plurality of blocks B1-B5 have different parasitic capacitors, the plurality of blocks B1-B5 have different feed through voltages ΔVP1-ΔVP5. For example, the feed through voltage ΔVP3 of the block B3 is the greatest, the feed through voltage ΔVP1 of the block B1 and the feed through voltage ΔVP5 of the block B5 are the smallest, and the feed through voltage ΔVP2 of the block B2 and the feed through voltage ΔVP4 of the block B4 exist between the feed through voltage ΔVP3 and the feed through voltage ΔVP1, the feed through voltage ΔVP5.

Please refer to FIG. 5. FIG. 5 is a diagram illustrating the liquid crystal display panel 400 still having flickers after the common voltage VCOM of the liquid crystal display panel 400 is adjusted. As shown in FIG. 5, when a designer of the liquid crystal display panel 400 adjusts the common voltage VCOM to let the block B3 not have flickers, because the plurality of blocks B1-B5 have the different feed through voltages ΔVP1-ΔVP5, the block B1 still has flickers due to a positive feed through voltage ΔVPP1 being not equal to a negative feed through voltage ΔVPN1. Similarly, the block B2, the block B4, the block B5, and the block B1 also have flickers.

Therefore, the designer of the liquid crystal display panel can not compensate flickers of the liquid crystal display caused by the feed through voltage by adjusting the direct current level of the common voltage VCOM.

SUMMARY OF THE INVENTION

An embodiment provides a device for reducing flickers of a liquid crystal display panel, where the liquid crystal display panel is divided into a plurality of blocks. The device includes a memory, a common voltage generation unit, and a controller. The memory is used for storing a plurality of initial codes, where each initial code corresponds to a block of the plurality of blocks and a common voltage. The controller is used for generating a control signal to the common voltage generation unit when the controller starts to count scan start signals corresponding to the block. The common voltage generation unit reads the initial code from the memory according to the control signal, and generates the common voltage to the block according to the initial code.

Another embodiment provides a method for reducing flickers of a liquid crystal display panel, where the liquid crystal display panel is divided into a plurality of blocks, a controller includes a memory, a common voltage generation unit, and a controller, the memory stores a plurality of initial codes, and each initial code corresponds to a block of the plurality of blocks and a common voltage. The method includes the controller generating a control signal to the common voltage generation unit when the controller starts to count scan start signals corresponding to the block; the common voltage generation unit reading the initial code from the memory according to the control signal; and the common voltage generation unit generating the common voltage to the block according to the initial code.

The present invention provides a device for reducing flickers of a liquid crystal display panel and a method for reducing flickers of a liquid crystal display panel. The device and the method utilize a controller to generate a control signal to a common voltage generation unit according to scan start signals corresponding to a block. Then, the common voltage generation unit reads a corresponding initial code from a memory according to the control signal, and generates a common voltage to the block according to the corresponding initial code. Therefore, compared to the prior art, because each of a plurality of blocks of the liquid crystal display panel corresponds to a respectively common voltage, a positive feed through voltage and a negative feed through voltage of each of the plurality of blocks are the same to let the liquid crystal display panel not have flickers.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
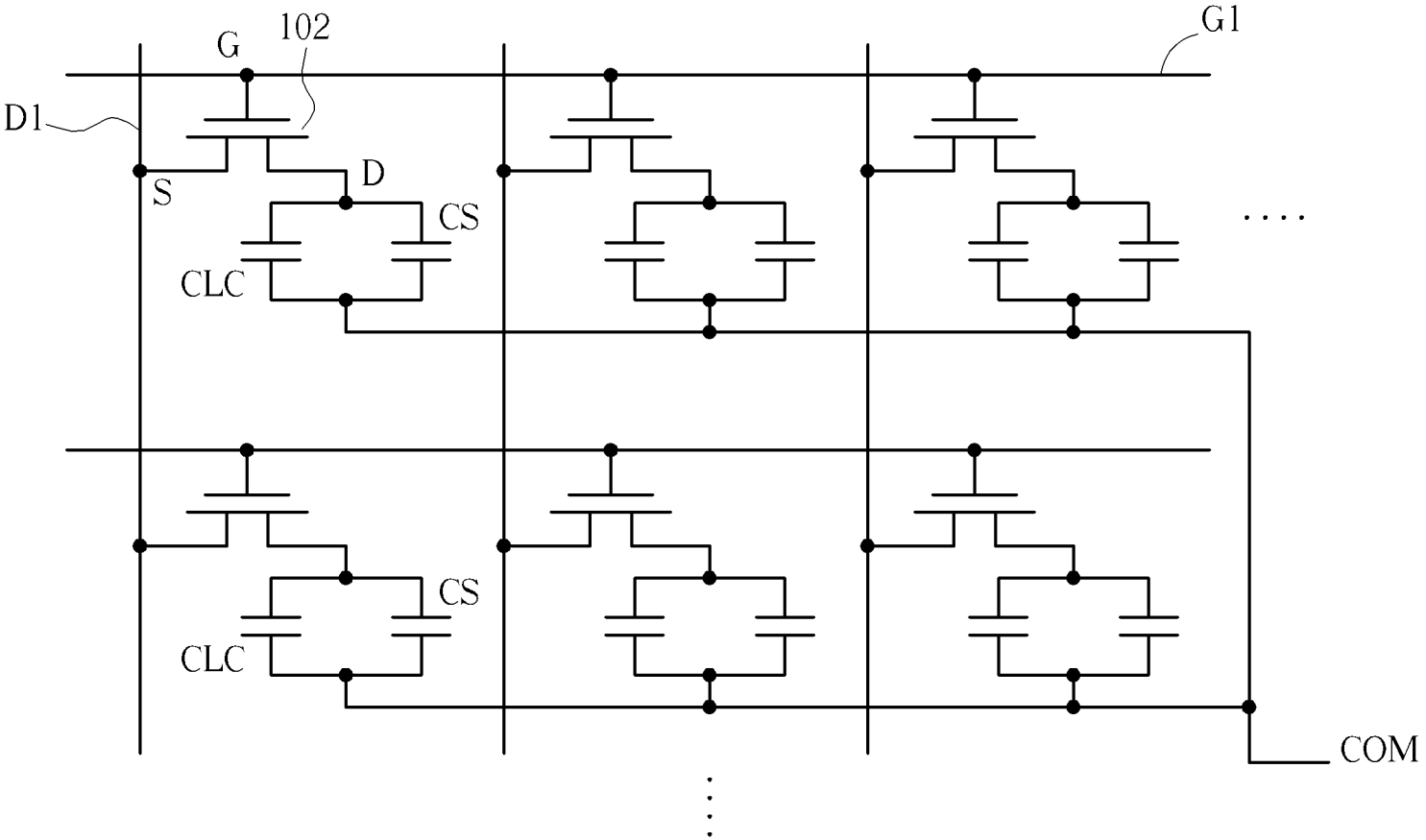
FIG. 1 PRIOR ART
FIG. 1 is a diagram illustrating a plurality of pixels included by a liquid crystal display.
Figure 2:
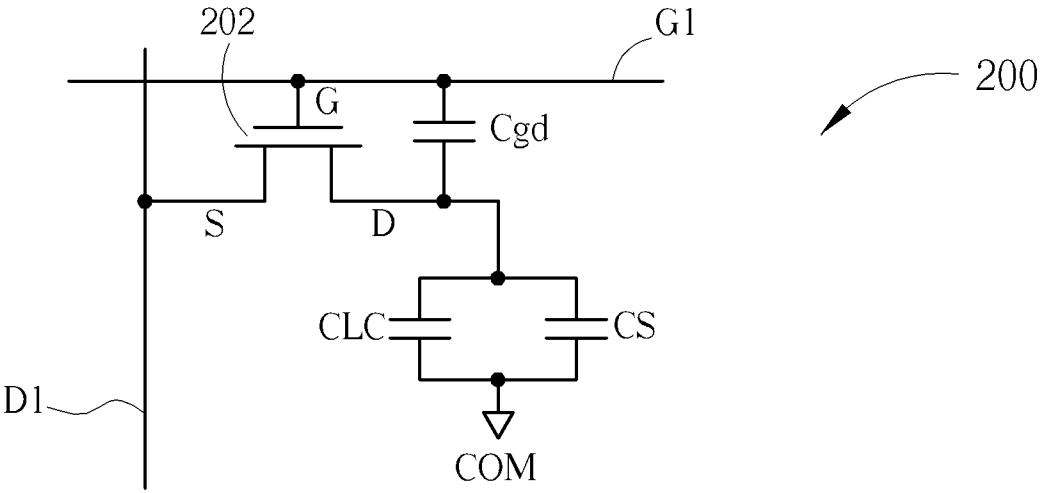
FIG. 2 PRIOR ART
FIG. 2 is a diagram illustrating a pixel of a liquid crystal display panel.
Figure 3:
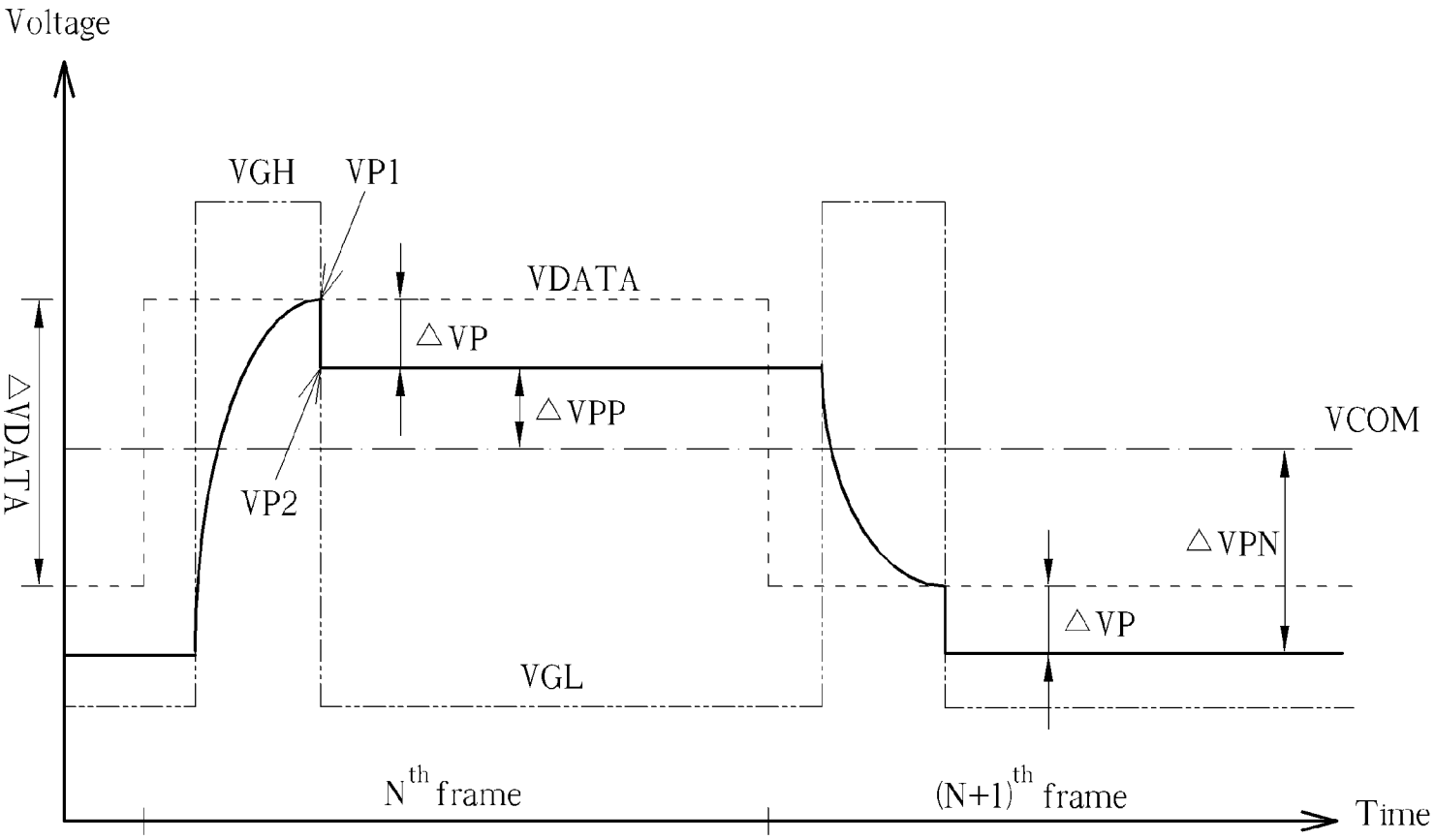
FIG. 3 PRIOR ART
FIG. 3 is a diagram illustrating relationships of a voltage stored in the storage capacitor and the liquid crystal capacitor, a data voltage of the data line, a common voltage, a high gate voltage and a low gate voltage of the gate line in FIG. 2.
Figure 4:
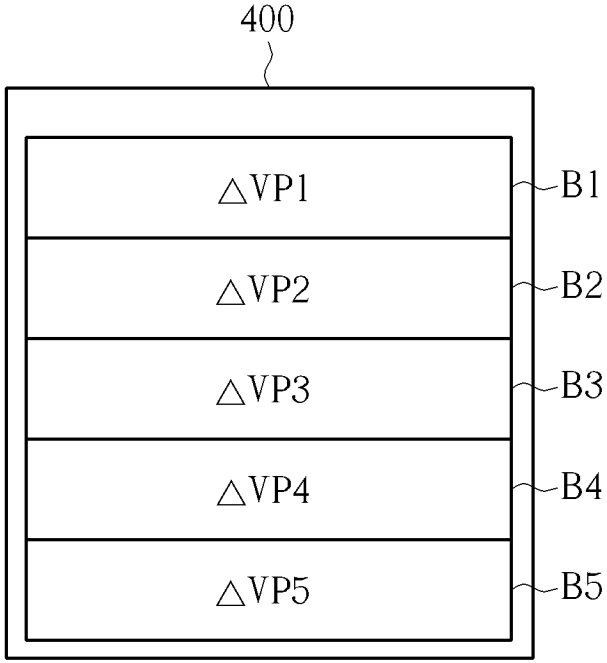
FIG. 4 PRIOR ART
FIG. 4 is a diagram illustrating a liquid crystal display panel having different feed through voltages.
Figure 5:
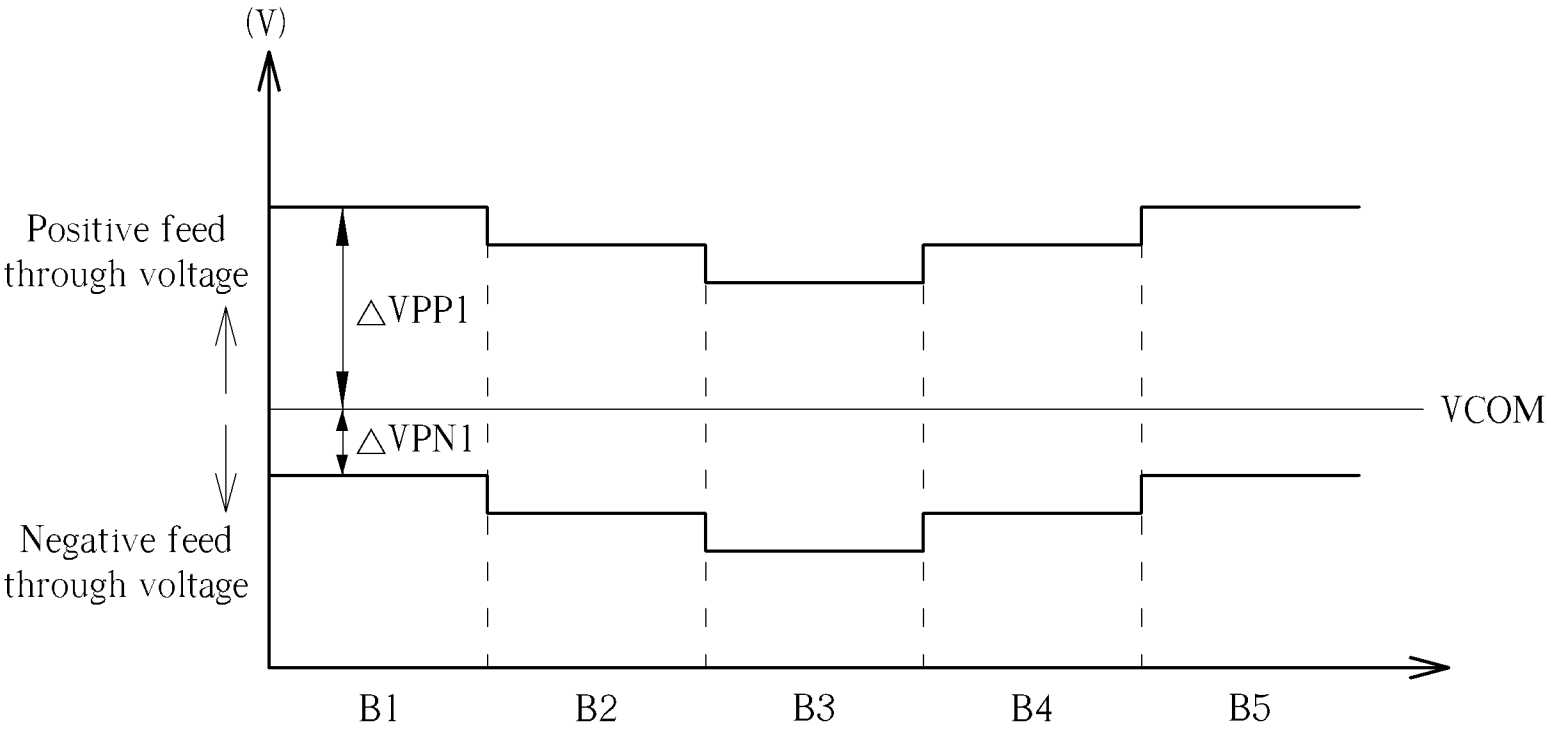
FIG. 5 PRIOR ART
FIG. 5 is a diagram illustrating the liquid crystal display panel still having flickers after the common voltage of the liquid crystal display panel is adjusted.
Figure 6:
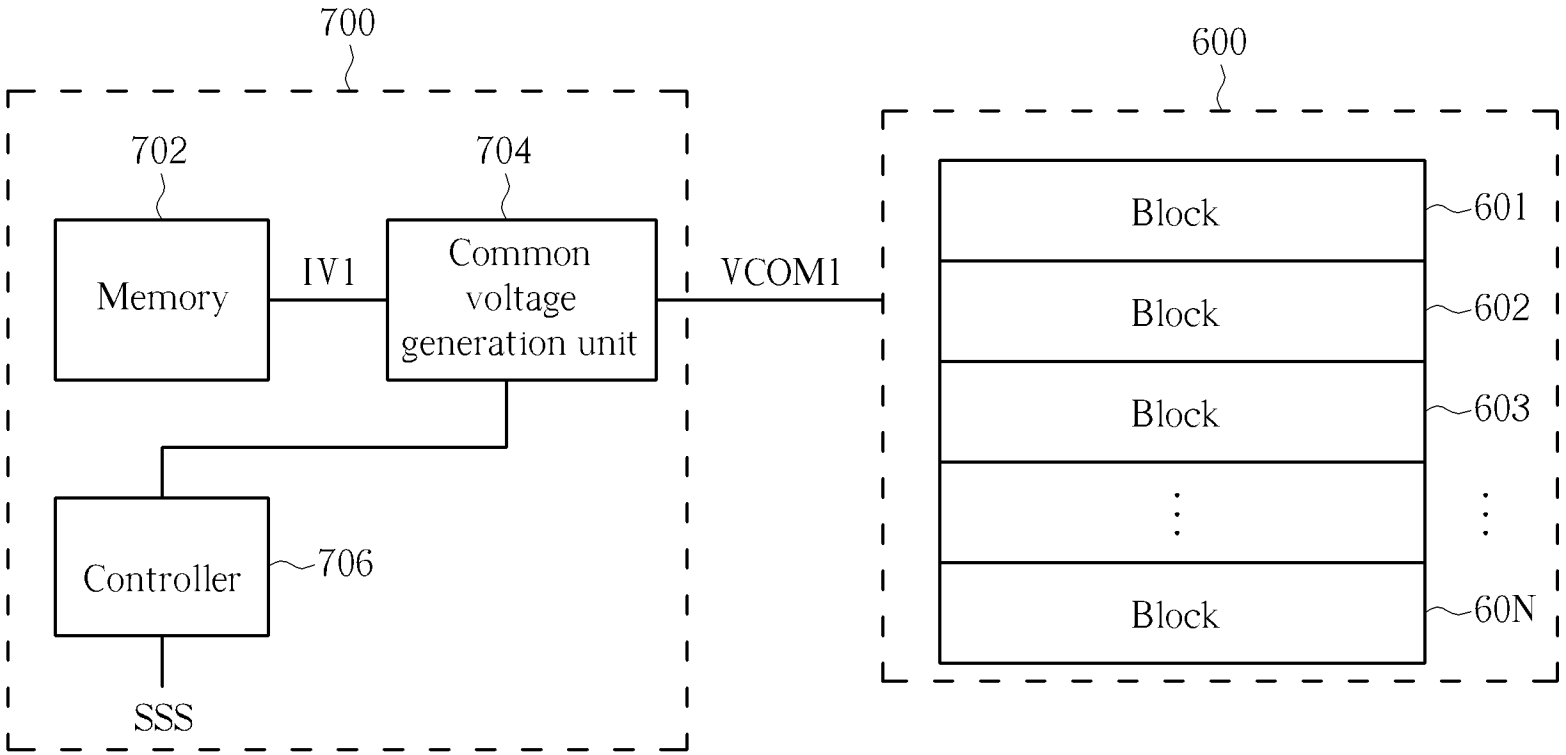
FIG. 6 is a diagram illustrating a device for reducing flickers of a liquid crystal display panel according to an embodiment.

Please refer to FIG. 6. FIG. 6 is a diagram illustrating a device 700 for reducing flickers of a liquid crystal display panel 600 according to an embodiment, where the liquid crystal display panel 600 is divided into a plurality of blocks 601-60N from top to bottom, and N is a positive integer. The device 700 includes a memory 702, a common voltage generation unit 704, and a controller 706, where the memory 702 can be a read-only memory. But, the present invention is not limited to the memory 702 being a read-only memory. That is to say, the memory 702 can also be another type memory. In addition, the memory 702, the common voltage generation unit 704, and the controller 706 are integrated into a timing controller coupled to the liquid crystal display panel 600. But, the present invention is not limited to the memory 702, the common voltage generation unit 704, and the controller 706 being integrated into the timing controller coupled to the liquid crystal display panel 600. That is to say, the memory 702, the common voltage generation unit 704, and the controller 706 can also be located on a printed circuit board coupled to the liquid crystal display panel 600. The memory 702 is used for storing plurality of initial codes, where each initial code corresponds to a block of the plurality of blocks 601-60N and a common voltage.

The controller 706 is used for generating a corresponding control signal to the common voltage generation unit 704 when the controller 706 starts to count scan start signals SSS corresponding to a block. The common voltage generation unit 704 reads a corresponding initial code from the memory 702 according to the corresponding control signal, and generates a corresponding common voltage to the block according to the corresponding initial code. For example, when the controller 706 starts to count scan start signals SSS corresponding to the block 601, the controller 706 generates a control signal CS1 corresponding to the block 601 to the common voltage generation unit 704. Then, the common voltage generation unit 704 reads an initial code IV1 corresponding to the block 601 from the memory 702 according to the control signal CS1 corresponding to the block 601, and generates a common voltage VCOM1 corresponding to the block 601 to the block 601 according to the initial code IV1 corresponding to the block 601. Thus, each of the plurality of blocks 601-60N corresponds to a respective common voltage.

Figure 7:
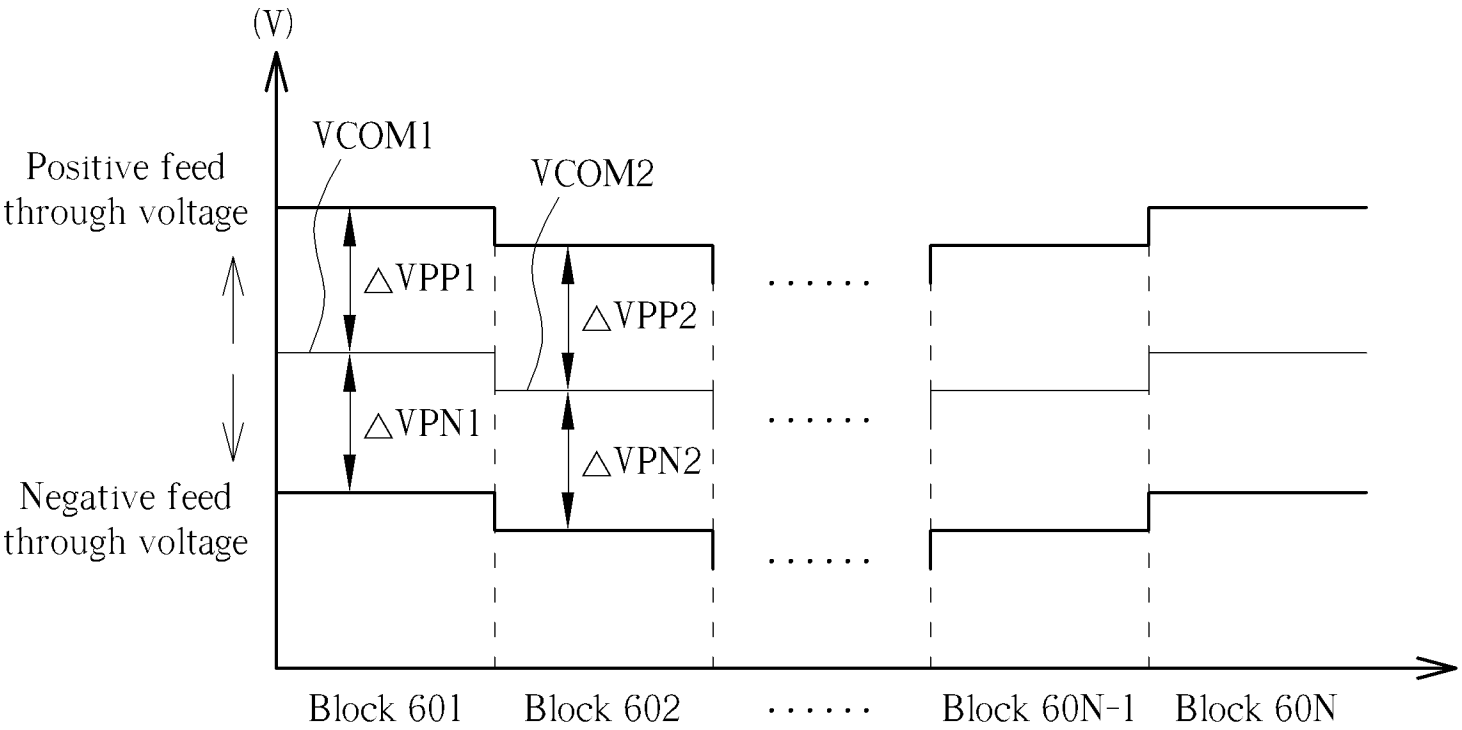
FIG. 7 is a diagram illustrating each of the plurality of blocks corresponding to a respective common voltage.

Please refer to FIG. 7. FIG. 7 is a diagram illustrating each of the plurality of blocks 601-60N corresponding to a respective common voltage. As shown in FIG. 6, because each of the plurality of blocks 601-60N corresponds to a respective common voltage, a positive feed through voltage and a negative feed through voltage of each of the plurality of blocks 601-60N are the same to let the liquid crystal display panel 600 not have flickers. For example, because the block 601 corresponds to the common voltage VCOM1, a positive feed through voltage ΔVPP1 and a negative feed through voltage ΔVPN1 of the block 601 are the same, resulting in the block 601 not having flickers. Similarly, because the block 602 corresponds to a common voltage VCOM2, a positive feed through voltage ΔVPP2 and a negative feed through voltage ΔVPN2 of the block 602 are the same, resulting in the block 602 not having flickers. In addition, those skilled in the scope of the present invention can easily know that subsequent operational principles of the blocks 603-60N are the same as those of the block 601, so further description thereof is omitted for simplicity.

Figure 8:
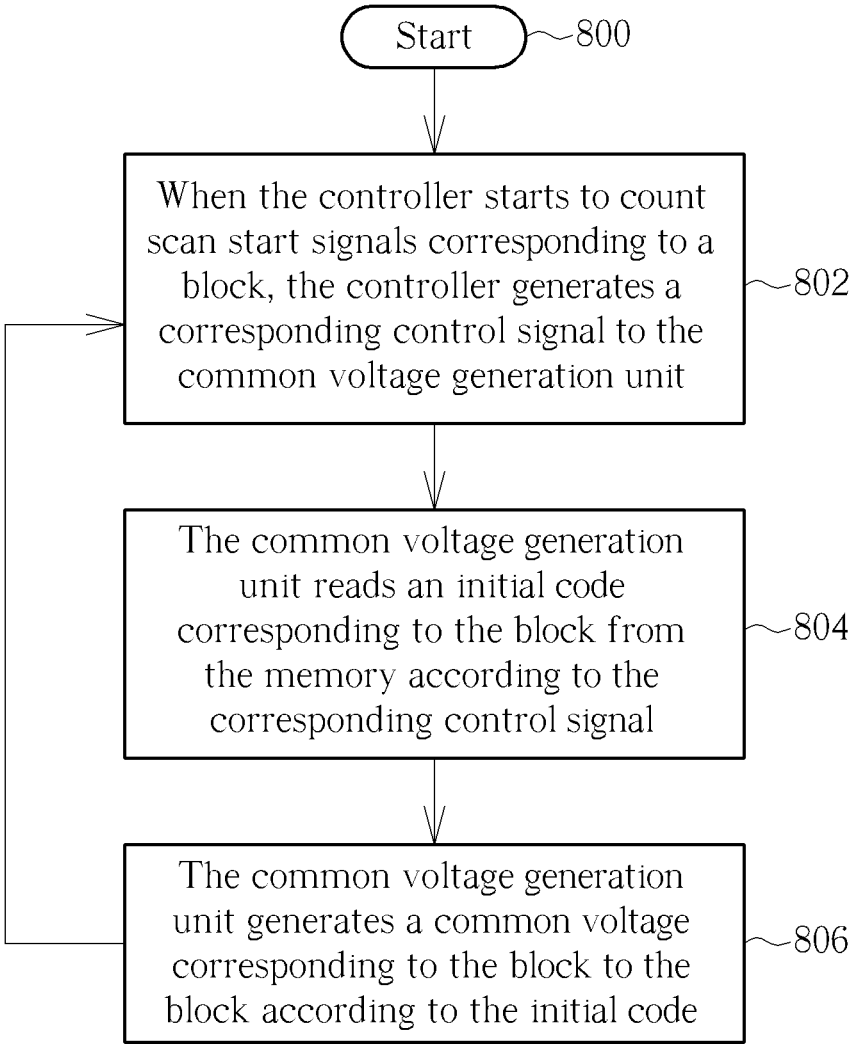
FIG. 8 is a method for reducing flickers of a liquid crystal display panel according to another embodiment.

Please refer to FIG. 6, FIG. 7, and FIG. 8. FIG. 8 is a method for reducing flickers of a liquid crystal display panel according to another embodiment. The method in FIG. 8 is illustrated using the liquid crystal display panel 600 and the device 700 in FIG. 6. Detailed steps are as follows:

Step 800: Start.

Step 802: When the controller 706 starts to count scan start signals corresponding to a block, the controller 706 generates a corresponding control signal to the common voltage generation unit 704.

Step 804: The common voltage generation unit 704 reads an initial code corresponding to the block from the memory 702 according to the corresponding control signal.

Step 806: The common voltage generation unit 704 generates a common voltage corresponding to the block to the block according to the initial code; go to Step 802.

Taking the block 601 as an example:

In Step 802, as shown in FIG. 6, when the controller 706 starts to count scan start signals SSS corresponding to the block 601, the controller 706 generates a control signal CS1 corresponding to the block 601 to the common voltage generation unit 704. In Step 804, the common voltage generation unit 704 reads an initial code IV1 corresponding to the block 601 from the memory 702 according to the control signal CS1 corresponding to the block 601, where the memory 702 can be a read-only memory. But, the present invention is not limited to the memory 702 being a read-only memory. That is to say, the memory 702 can also be another type memory. In Step 806, the common voltage generation unit 704 generates a common voltage VCOM1 corresponding to the block 601 to the block 601 according to the initial code IV1 corresponding to the block 601. Then, the above mentioned Steps can be executed on each of the plurality of blocks 602-60N repeatedly. Therefore, each of the plurality of blocks 601-60N corresponds to a respective common voltage. As shown in FIG. 6 and FIG. 7, because each of the plurality of blocks 601-60N corresponds to a respective common voltage, a positive feed through voltage and a negative feed through voltage of each of the plurality of blocks 601-60N are the same to let the liquid crystal display panel 600 not have flickers. For example, because the block 601 corresponds to the common voltage VCOM1, a positive feed through voltage ΔVPP1 and a negative feed through voltage ΔVPN1 of the block 601 are the same, resulting in the block 601 not having flickers. In addition, those skilled in the scope of the present invention can easily know that subsequent operational principles of the blocks 602-60N are the same as those of the block 601, so further description thereof is omitted for simplicity.

To sum up, the device for reducing flickers of a liquid crystal display panel and the method for reducing flickers of a liquid crystal display panel utilize the controller to generate a control signal to the common voltage generation unit according to scan start signals corresponding to a block. Then, the common voltage generation unit reads a corresponding initial code from the memory according to the control signal, and generates a common voltage to the block according to the corresponding initial code. Therefore, compared to the prior art, because each of the plurality of blocks of the liquid crystal display panel corresponds to a respectively common voltage, a positive feed through voltage and a negative feed through voltage of each of the plurality of blocks are the same, resulting in the liquid crystal display panel not having flickers.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A device for reducing flickers of a liquid crystal display panel, the liquid crystal display panel being divided into a plurality of blocks, the device comprising:

a memory for storing a plurality of initial codes, wherein each initial code corresponds to a block of the plurality of blocks and a common voltage, a plurality of common voltages corresponding to the plurality of blocks being distinct;

a common voltage generation unit; and a controller for generating a control signal to the common voltage generation unit when the controller starts to count scan start signals corresponding to the block;

wherein the common voltage generation unit reads the initial code from the memory according to the control signal, and generates the common voltage to the block according to the initial code; and wherein each of the common voltages substantially equals to an average of a positive feed through voltage and a negative feed through voltage of a corresponding block.

2. The device of claim 1, wherein the memory, the common voltage generation unit, and the controller are integrated into a timing controller coupled to the liquid crystal display panel.

3. The device of claim 1, wherein the memory, the common voltage generation unit, and the controller are located on a printed circuit board coupled to the liquid crystal display panel.

4. The device of claim 1, wherein the liquid crystal display panel is divided into the plurality of blocks from top to bottom.

5. The device of claim 1, wherein the memory is a read-only memory.

6. A method for reducing flickers of a liquid crystal display panel, the liquid crystal display panel being divided into a plurality of blocks, a device comprising a memory, a common voltage generation unit, and a controller, the memory storing a plurality of initial codes, and each initial code corresponding to a block of the plurality of blocks and a common voltage, the method comprising:

the controller generating control signals to the common voltage generation unit when the controller starts to count scan start signals corresponding to the blocks;

the common voltage generation unit reading the initial codes from the memory according to the control signals; and the common voltage generation unit generating a plurality of distinct common voltages to the blocks according to the initial codes;

wherein each of the common voltages substantially equals to an average of a positive feed through voltage and a negative feed through voltage of a corresponding block.

7. The method of claim 6, wherein the memory, the common voltage generation unit, and the controller are integrated into a timing controller coupled to the liquid crystal display panel.

8. The method of claim 6, wherein the memory, the common voltage generation unit, and the controller are located on a printed circuit board coupled to the liquid crystal display panel.

9. The method of claim 6, wherein the liquid crystal display panel is divided into the plurality of blocks from top to bottom.

10. The method of claim 6, wherein the memory is a read-only memory.

* * * * *